US005381742A

United States Patent [19]

Linton et al.

[11] Patent Number: 5,381,742

[45] Date of Patent: Jan. 17, 1995

[54] WASTE LIQUID EVAPORATOR

[75] Inventors: Paul Linton; Richard C. Shepherd, both of Vancouver, Wash.; Brian K. Fisk, Portland; Billy G. Epperson, Jr., Hillsboro, both of Oreg.

[73] Assignee: Landa, Inc., Portland, Oreg.

[21] Appl. No.: 123,189

[22] Filed: Sep. 17, 1993

[51] Int. Cl.[6] ..... F23G 7/04

[52] U.S. Cl. ..... 110/238; 110/235; 110/341; 110/346

[58] Field of Search ..... 110/238, 235, 341, 346

[56] References Cited

U.S. PATENT DOCUMENTS

| | | | |
|---|---|---|---|
| 3,423,293 | 1/1969 | Holden . | |
| 3,480,515 | 11/1969 | Goeldner . | |
| 3,676,307 | 7/1972 | Black . | |
| 3,779,452 | 12/1973 | Nau et al. . | |
| 3,956,128 | 5/1976 | Turner . | |
| 4,216,091 | 8/1980 | Mineau . | |
| 4,351,252 | 9/1982 | Shindome et al. | 110/238 |
| 4,361,100 | 11/1982 | Hinger | 110/238 |
| 4,665,894 | 5/1987 | Juhasz . | |
| 4,671,856 | 6/1987 | Sears . | |
| 4,700,637 | 10/1987 | McCartney | 110/237 |
| 4,769,113 | 9/1988 | Sears . | |
| 4,773,390 | 9/1988 | Watts . | |
| 4,869,067 | 9/1989 | Sears . | |
| 4,919,592 | 4/1990 | Sears et al. . | |
| 4,976,824 | 12/1990 | Lee . | |
| 4,978,429 | 12/1990 | Sears et al. . | |
| 5,017,284 | 5/1991 | Miler et al. . | |
| 5,032,230 | 7/1991 | Shepherd . | |
| 5,082,525 | 1/1992 | Travis . | |
| 5,156,098 | 10/1992 | Camp | 110/212 |
| 5,323,715 | 6/1994 | Fujiwara et al. | 110/238 |

OTHER PUBLICATIONS

The Original Nordalc Fluid Eliminator—Model 1000.
Enviro-Vap; manufactured by Water Vap Systems, Inc.
EcoVap 2000.
Hot Tube Industrial Waste-Water Evaporator: The Lakeview E-Series Evaporator; Lakeview Engineered Products; manufactured by Power Plant Service, Inc.
Cold Vaporization Units; manufactured by Calfran International, Inc.
Aquavap; manufactured by Licon, Inc.
The Emtec Waste Liquid Reducer; manufactured by Environmental Management Technologies, Inc.
DYNA 7 System; manufactured by DCI Corporation.

*Primary Examiner*—Henry C. Yuen
*Attorney, Agent, or Firm*—Kolisch, Hartwell, Dickinson McCormack & Heuser

[57] ABSTRACT

The invented waste liquid evaporator includes a burner for producing a flame and a liquid injector for injecting waste liquid directly into the flame. The flame vaporizes the liquid, burns pollutants in the liquid, and produces a vapor exhaust stream. A tank catches the vapor and any waste liquid that was not vaporized. The vapor leaves the tank through a vent, after which it can be exhausted to atmosphere or condensed for recovery. Any liquid in the tank, either from condensation, waste liquid that was not vaporized, or other sources, is also heated for evaporation. The invented method includes the steps of producing a flame, injecting waste liquid directly into the flame to burn at least a part of any combustible pollutants in the waste liquid and to volatilize the waste liquid, providing a tank, catching in the tank the waste liquid and the vapor after the waste liquid is injected into the flame, and providing a vent in the tank to allow the vapor to leave the tank.

18 Claims, 9 Drawing Sheets 10
182
184
250
272
274
252
254
260
180
105
78
202
270
200
262
142
132
104
90
102
98
120
192
194
195
196
232
204
52
208
236
26
56
34
30
32
14
54
206
96
94
28
193
210
234
92
36
50
64
20
22
62
70
24
72
134

122
105
124
270
170
90
142
132
120

WASTE LIQUID EVAPORATOR

FIELD OF THE INVENTION

The present invention relates generally to waste liquid evaporators and to methods of evaporation. More particularly, the invention relates to a waste liquid evaporator that evaporates waste liquid by injecting it into a flame.

BACKGROUND ART

An evaporator is an apparatus that changes a solid or liquid into a gas or vapor. Evaporators are used, for example, to evaporate a waste liquid, like dirty water, thus separating the liquid from wastes, like oil or solvents, contained in the liquid. Evaporators may be used to dispose of dirty water used to clean machinery, water used to help pump oil out of oil wells, and numerous other applications.

A conventional waste liquid evaporator includes a heating element like a heating coil or plate. The heating element is submerged in a waste liquid to heat the liquid to boiling, thus converting the liquid to vapor.

Often the waste liquid contains contaminants. The contaminants become caked on the heating element when the heating element heats the liquid. The caked-on contaminants act as an insulator, reducing the efficiency of the evaporator. The evaporator must then be disassembled and the contaminants removed from the heating elements to keep the evaporator in proper working condition.

It is an object of the invention described in this document to address that problem by evaporating waste liquid in such a way that the primary evaporation occurs while the liquid is not in contact with a surface on which deposits can form.

Conventional evaporators may also leave behind pollutants, like wood pulp or paint chips, after a waste liquid is evaporated. Those pollutants must then be disposed of.

Another object of this invention is to minimize the pollutants resulting from the evaporation process.

Evaporators also require energy to vaporize waste liquids. Another object of this invention is to efficiently use energy.

SUMMARY OF THE INVENTION

The invented waste liquid evaporator includes a burner for producing a flame and a liquid injector for injecting waste liquid directly into the flame. The flame vaporizes the liquid, burns pollutants in the liquid, and produces a vapor exhaust stream. The exhaust stream includes the resulting vapor, exhaust products from production of the flame, and particles resulting from the combustion or precipitation of any pollutants contained in the waste liquid.

A tank catches the vapor and any waste liquid that was not vaporized. The vapor leaves the tank through a vent, after which it can be exhausted to atmosphere or condensed for recovery. Any liquid in the tank, either from condensation, waste liquid that was not vaporized, or other sources, is also heated for evaporation.

One embodiment of the invention includes a tank that holds liquid and a tube submerged in the liquid. A burner is positioned to produce a flame in the tube and a waste liquid injector is positioned to inject waste liquid into the flame. The flame vaporizes the waste liquid and burns pollutants. The vapor and any remaining waste liquid then leave the tube through holes located in the tube. The burner includes an air injector that injects air into the tube. The air in the tube helps produce the flame and prevents liquid from entering the submerged tube through the holes while still allowing vapor and waste liquid to leave the tube through the holes. The vapor leaves the tube as bubbles because the tube is submerged, and the bubbles float to the surface of the liquid.

Bubbling the vapor through the liquid serves several functions. First, the vapor bubbles transfer a significant amount of thermal energy to the liquid held in the tank. If the liquid in the tank is also to be evaporated, this improves the efficiency, of the evaporator. Second, the temperature at which vaporization of the liquid in the tank occurs is reduced, thereby improving the efficiency of the evaporator. Third, the liquid in the tank cools the vapor so that the temperature of the vapor when it leaves the tank is reduced. This improves the safety of the evaporator. And fourth, particles are removed from the exhaust stream and accumulate in the tank because the liquid in the tank acts as a scrubber. Thus the evaporator produces a relatively clean vapor stream.

DETAILED DESCRIPTION AND BEST MODE OF CARRYING OUT THE INVENTION

Figure 1:
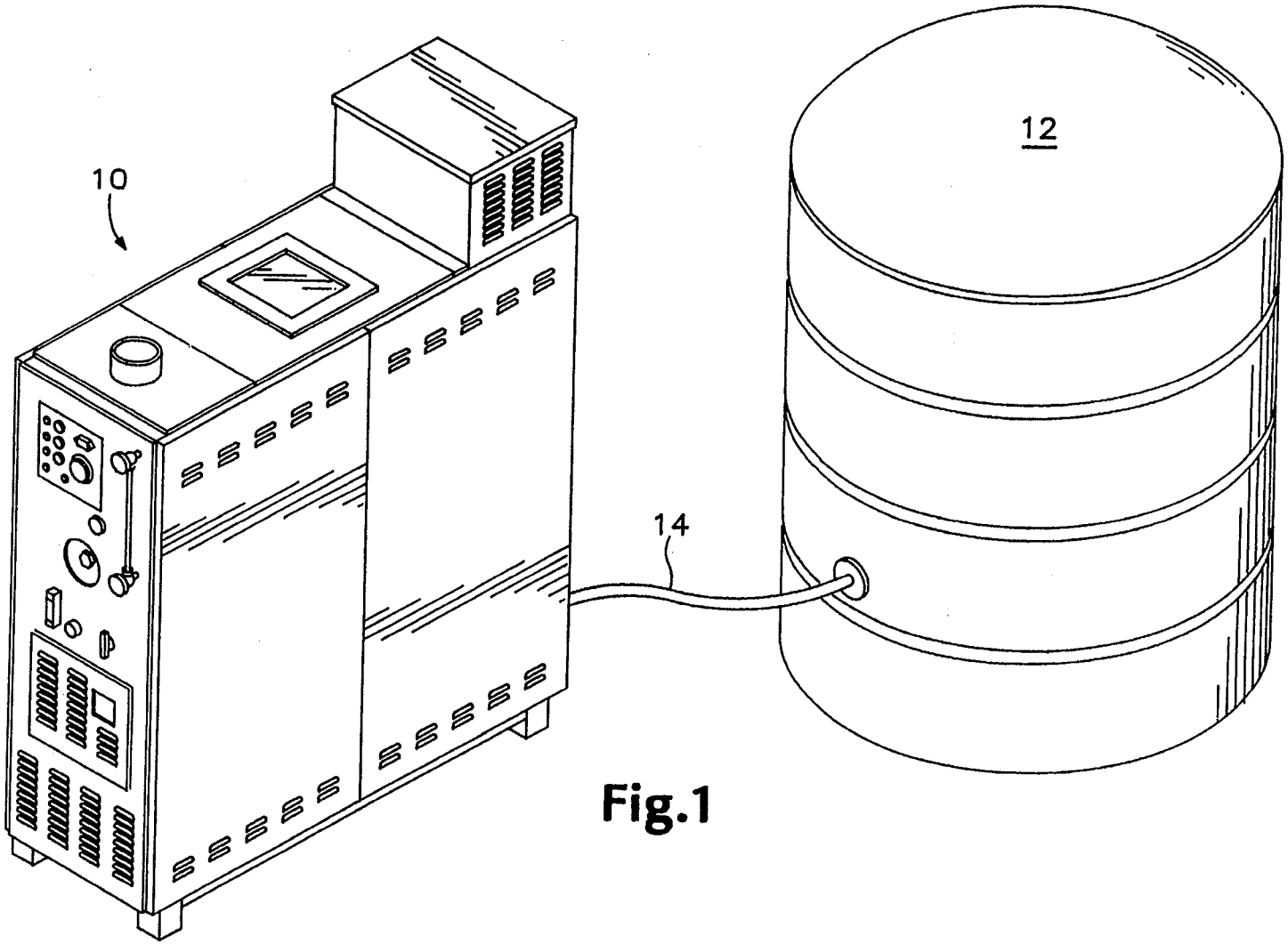
FIG. 1 shows a waste liquid evaporator built in accordance with one embodiment of the present invention.

The invented waste liquid evaporator is shown at 10 in FIG. 1. Evaporator 10 is connected to a supply of waste liquid 12 by a hose 14.

Figure 2:
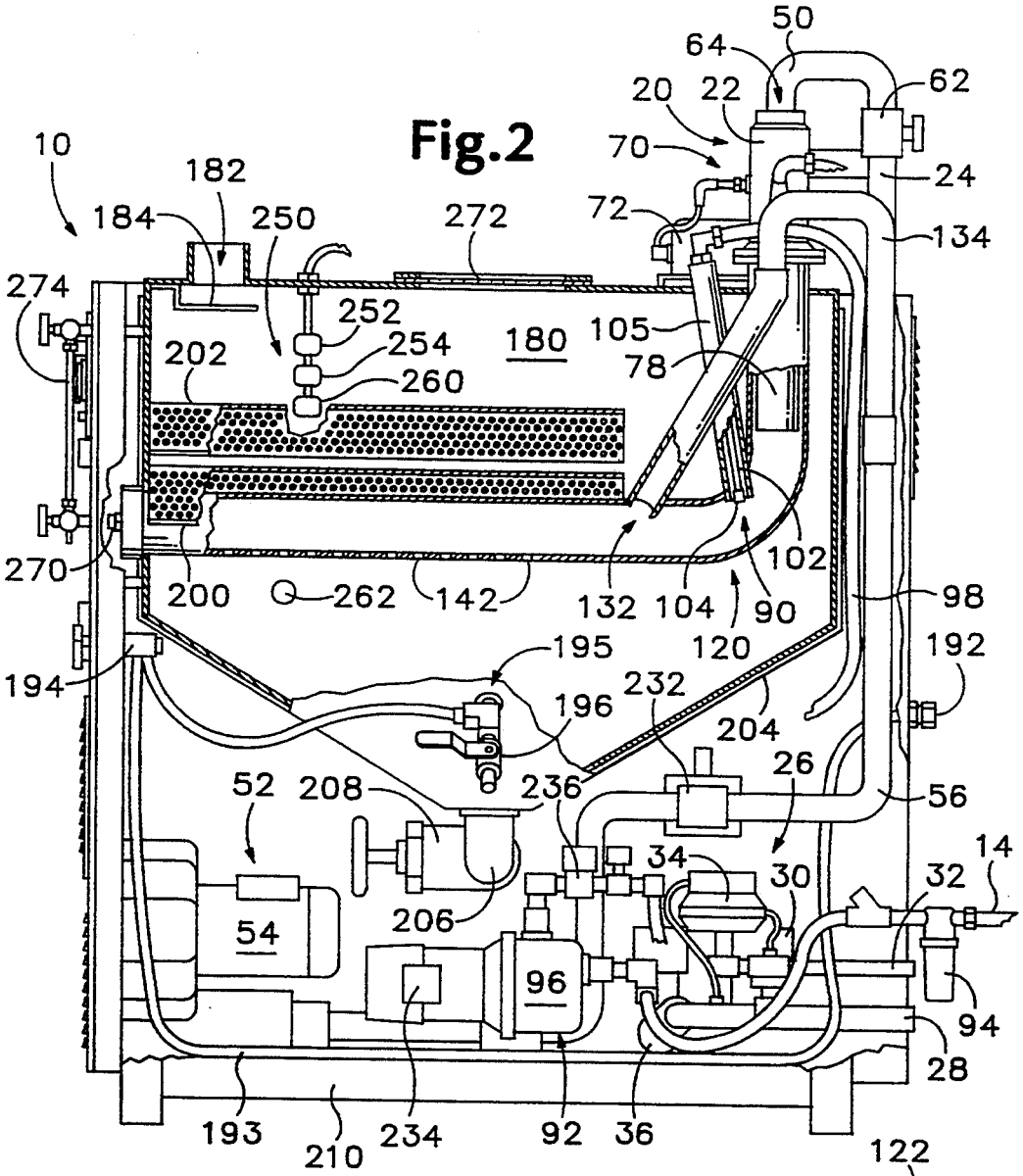
FIG. 2 is a side view of the waste liquid evaporator shown in FIG. 1, with portions of the housing removed, and with several internal parts shown in partial cross-section.
Figure 3:
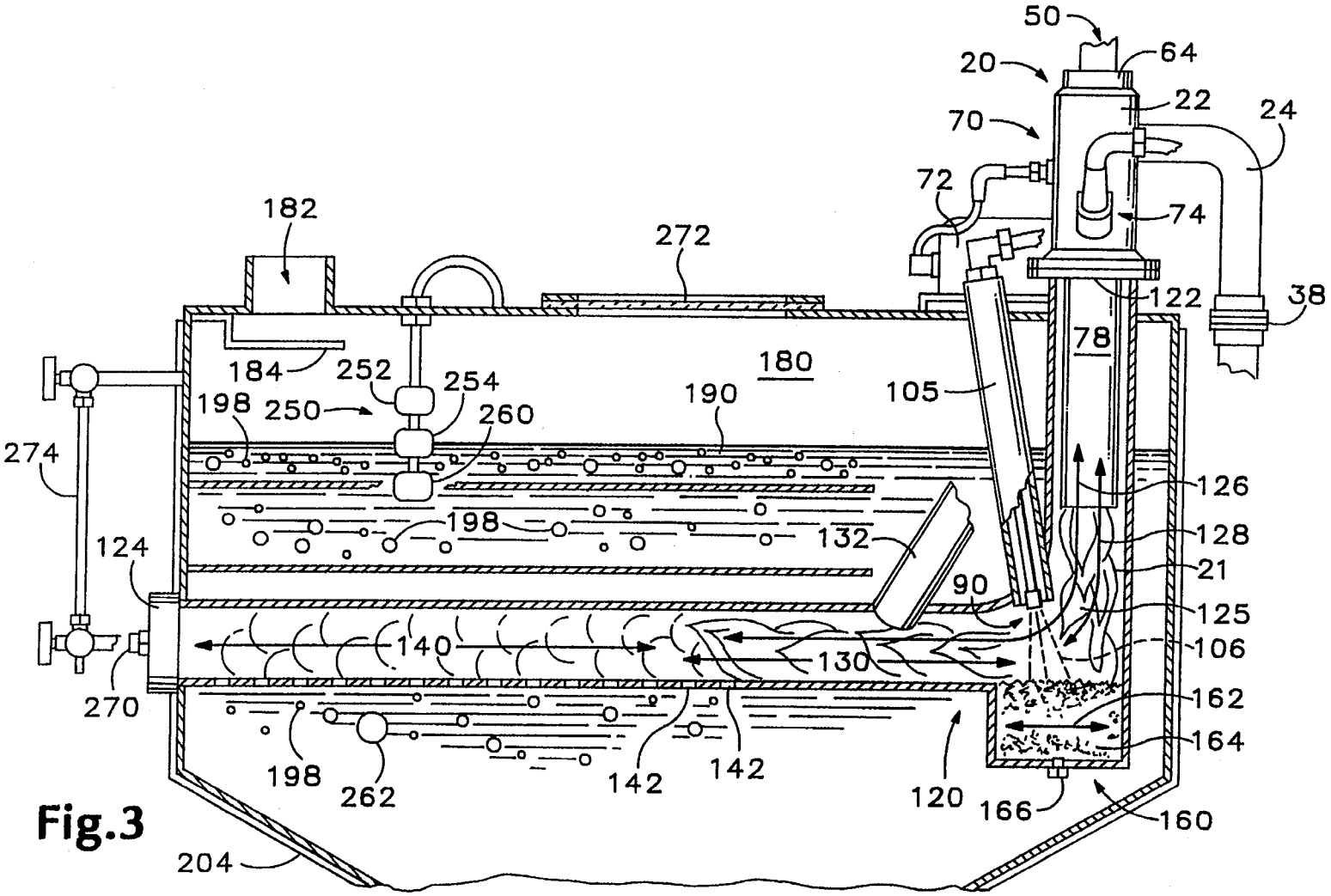
FIG. 3 is an enlarged fragmentary side view of the waste liquid evaporator shown in FIG. 2, showing several parts in operation, and showing an alternative embodiment of one part.
Figure 4:
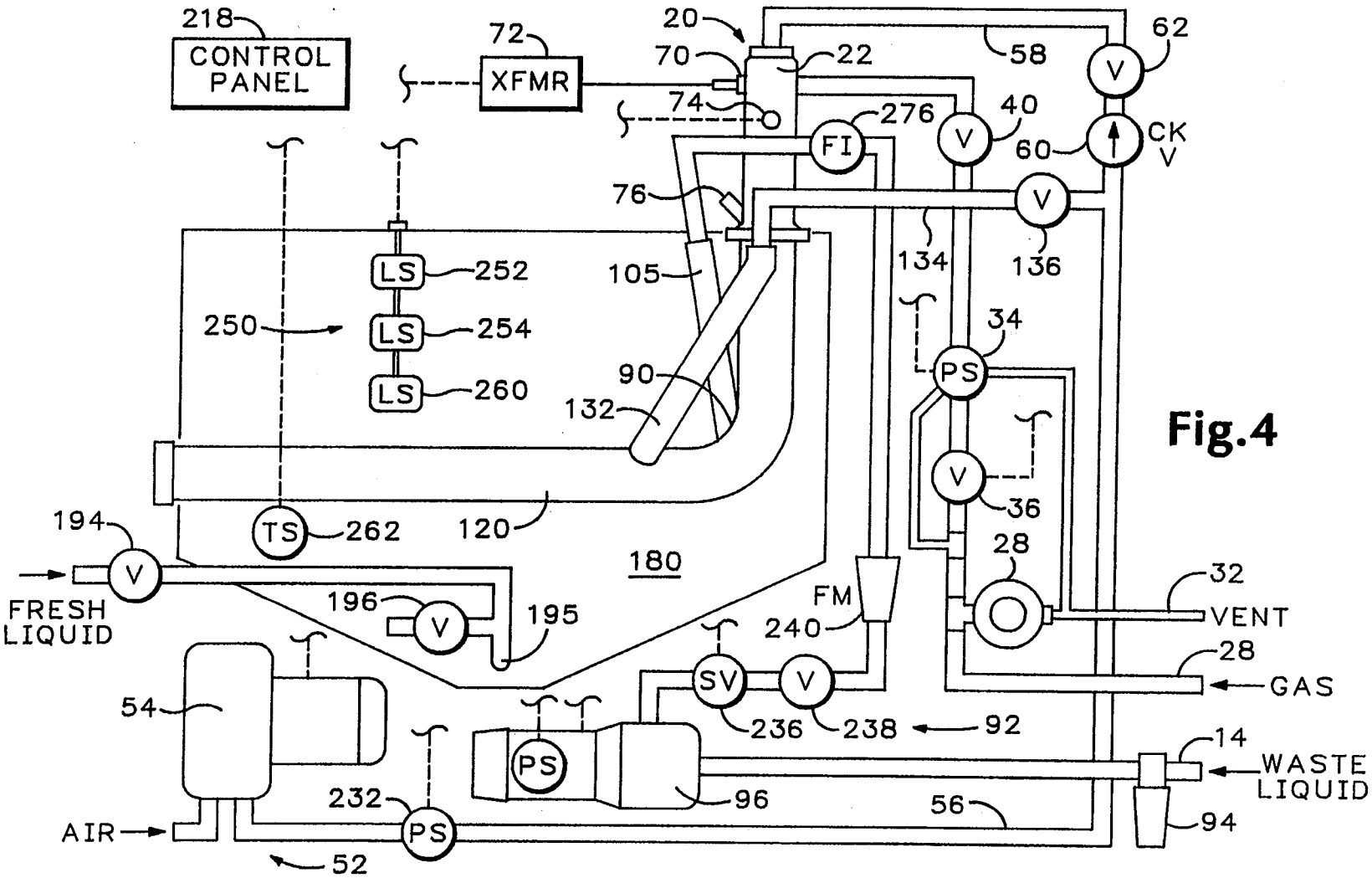
FIG. 4 is a simplified piping diagram of the waste liquid evaporator shown in FIGS. 1 through 3.

Evaporator 10 includes a burner 20, shown in FIGS. 2 through 4. Burner 20 produces a flame 21 which is used to evaporate waste liquid. An example of burner 20 is manufactured by Eclipse Combustion of Rockford, Ill., and is a tube-firing burner Model 51.5 MVTA.

Burner 20 includes a burner housing 22 with multiple ports. One port is a fuel inlet 24. A constant flow of fuel is supplied to burner 20 through fuel inlet 24 by a fuel supply assembly, shown generally at 26 in FIGS. 2 and 4. The preferred fuel is natural gas. However, the use of other readily combustible fuels is envisioned within the scope of the invention.

Fuel supply assembly 26 maintains a constant fuel supply rate. The assembly includes a fuel supply line 28 which leads to a pressure regulator 30. Regulator 30 regulates the pressure of fuel supplied to burner 20. Regulator 30 vents to atmosphere by vent tube 32. An example of pressure regulator 30 is also manufactured by Equimeter Inc. and is a gas pressure regulator Model 043-182.

A high/low safety shut-off switch 34 (PS) shuts off the flow of fuel should the pressure in the fuel supply line exceed or drop below preset pressure limits. An example of high/low safety shut-off switch 34 is manufactured by Antunes Controls of Addison, Ill., and is a Model RHLGP high/low pressure switch. A fuel shut-off solenoid valve 36 (V) allows automatic on-off control of the fuel supply. An example of fuel shut-off solenoid valve 36 is manufactured by Eclipse Combustion and is a Model MVDLE solenoid valve. An orifice plate 38 allows a pressure gauge (not shown) to be attached to monitor the flow of fuel to burner 20. An example of orifice plate 38 is manufactured by Eclipse Combustion and is a Series FOM flanged metering orifice. A manual fuel shut-off valve, shown at 40 (V), includes a preset restriction and allows manual override of the flow of fuel to burner 20. An example of manual fuel shut-off valve 40 is manufactured by Eclipse Combustion and is an adjustable orifice gas cock Part No. 10627.

Another port in burner housing 22 is an air inlet 50. Air is supplied to burner 20 through air inlet 50 by an air supply assembly, shown generally at 52 in FIGS. 2 and 4.

Air supply assembly 52 includes a regenerative blower 54. An example of regenerative blower 54 is manufactured by Gast of Benton Harbor, Mich., and is a REGENAIR ® R3 series blower.

Blower 54 is connected to burner 20 by air supply line 56. Air supply line 56 directs air to a burner air supply line 58. Line 58 contains a check valve 60 (CK V) to prevent air from flowing back into line 56 and a manual valve 62 (V) further controls the air supplied to the burner. Line 58 terminates in an air injector shown at 64. Air injector 64 provides air to burner 20. Injector 64 often is simply the termination of line 58, but the use of a nozzle or other device to direct the injection of air is envisioned within the scope of this invention. An example of check valve 60 is manufactured by Eclipse Combustion and is a Series 1000 disc type check valve. An example of manual valve 62 is also manufactured by Eclipse Combustion, and is a manual butterfly valve Model 404BV.

The fuel from fuel supply assembly 26 and the air from air supply assembly 52 are mixed by burner 20 to produce flame 21. The mixture is ignited by a spark plug in a spark plug port, shown generally at 70 in FIGS. 2 and 3, on burner housing 22. A transformer 72 (XFMR), also shown in FIGS. 2 and 3, provides the appropriate voltage to the spark plug, and is connected to a source of electric energy in any known manner.

The temperature of the flame produced by burner 20 typically ranges from 1800° to 2200° F. degrees Fahrenheit, depending on the adjustment of fuel and air to the burner. That temperature is sufficient to flash water to steam and to burn pollutants in the water, like hydrocarbons, etc. The mixture of fuel to air in burner 20 can be adjusted by adjusting the amount of air injected by air injector 64. This is accomplished by opening or closing manual valve 62.

Burner housing 22 also includes a flame sensor port containing a flame sensor, shown generally at 74. The flame sensor detects the presence or absence of a flame and shuts off the fuel supply if the fuel is not ignited. Specifically, a no-flame gas shut-off control 75 monitors the flame sensor, and disables burner 20 when no flame is sensed. An example of a no-flame gas shut-off control 75 is manufactured by Eclipse-Dungs Controls L.P. of Rockford, Ill., and is a Veri-Flame Purge Controller Model 5602-22.

A burner view port 76 is also included in burner housing 22. Burner view port 76 allows for visual checking of the flame.

A flame tube 78, which may be manufactured of 330 stainless steel, is preferably attached to burner 20, and focuses the flame to provide a more intense source of heat. Larger burners may require a tapered nozzle 80 to further focus the flame.

Evaporator 10 also includes a waste liquid injector 90 to inject waste liquid directly into flame 21. Pressurized waste liquid is fed to injector 90 by a liquid supply assembly, shown generally at 92 in FIGS. 2 and 4. As stated earlier, a common example of such liquid is waste water that has been contaminated by solvents, hydrocarbons, paint or numerous other pollutants. Nevertheless, the evaporation of other waste liquids is envisioned within the scope of this invention.

Liquid supply assembly 92 takes waste liquid from container 12, or any other source of waste liquid. The liquid is pumped from container 12 through hose 14 to a liquid prefilter 94 by a liquid pump 96 and then through a liquid supply line 98 to the liquid injector 90. An example of liquid pump 96 is manufactured by Grundfos of Fresno, Calif. and is a Jet Star Pump Model No. JP-5.

Liquid injector 90 includes an injection tube 102 having on its end an injector nozzle 104. Injection tube 102 and nozzle 104 are mounted in a casing 105 so that the injection tube and nozzle can be removed and maintained. An example of injector nozzle 104 is manufactured by Landa, Inc. of Portland, Oreg., and is Model No. 95-07400014. Feeding pressurized liquid through injection tube 102 to nozzle 104 produces a fine spray of injected waste liquid, shown generally at 106 in FIG. 3.

Liquid injector 90 is positioned adjacent burner 20 so that waste liquid in injected directly into flame 21, as shown in FIG. 3. Injecting liquid directly into flame 21 volatilizes or vaporizes the liquid while it is suspended in the flame. The liquid is therefore evaporated without the need for a heat exchanger surface on which deposits could form.

If the injected liquid contains combustible contaminants or pollutants, those pollutants are burned by flame 21. Burning the pollutants cleans the liquid somewhat. The burning pollutants also provide an additional source of energy, thus further increasing the efficiency of the evaporator.

The combination of burning fuel to produce a flame, volatilizing injected liquid, and burning combustible contaminants produces an exhaust stream, shown generally at 110 in FIG. 3. Exhaust stream 110 initially contains the products of combustion (usually water and heated air) from burning the fuel, vapor from volatilizing injected liquid 106, and particles, including ash from burning combustible contaminants and precipitates from precipitating noncombustible contaminants.

Burner 20 and liquid injector 90 are both connected to a tube 120, shown in FIGS. 2 through 4, which may be manufactured of 304 stainless steel. Tube 120 has an open top shown at 122 and a closed end shown at 124. In FIGS. 2 through 4 tube 120 includes an elbow bend 125. While tube 120 is described and shown as a bent cylindrical tube, many alternative configurations can be used.

A portion of tube 120 is referred to as a combustion section 126, and is generally the portion of tube 126 adjacent burner 20 and injector 90. Combustion section 126 can be viewed as having two ends, a first end region 128 closest to burner 20, and a second end region 130 distant from burner 20 and beyond bend 125.

Burner 20 produces flame 21 inside of the combustion section of tube 120, as shown in FIG. 3. Often the flame will extend in tube 120 around and beyond bend 125. Liquid injector 90 also injects waste liquid into the flame inside of tube 120.

An auxiliary or second air injector 132 connects to second end region 130 downstream from burner 20 and liquid injector 90. Injector 132 forces air into tube 120. Air supply assembly 52 feeds air to second air injector 132. Specifically, air supply line 56 splits into burner air supply line 58, previously mentioned, and supplemental air supply line 134, as shown in FIG. 4. Supplemental air supply line 134 includes a manual valve shown at 136 (V), and terminates in second air injector 132. Injector 132 is often simply the termination of line 134, but the use of a nozzle or other device to direct the injection of air is envisioned within the scope of this invention.

The temperature of flame 21 can also be adjusted by changing the amount of air released through second air injector 132, which is controlled by manual valve 136. Releasing more air from second air injector 132 decreases the amount of air injected by air injector 64, increasing the fuel to air ratio in the burner.

The arrangement of burner 20, liquid injector 90 and tube 120 volatilizes or vaporizes injected liquid 106. Flame 21 extends into tube 120 from first end region 128 to second end region 130, and volatilizes (or flashes) injected liquid 106 within combustion section 126. Flame 21, now containing liquid, vapor, ash particles and unburned combustible components, is forced into second end region 130, where second air injector 132 injects additional air into the flame. The additional air promotes more complete combustion of the combustible components still in the flame. It has been found that second air injector 132 allows burner 20 to produce more heat output because more fuel can be burned in tube 120 than could be burned without the second air injector. This is accomplished by running burner 20 rich (injecting more fuel relative to air). For example, a burner that usually produces around 150,000 BTU's can now produce around 160,000 to 180,000 BTU's.

Another portion of tube 120 is referred to as sparger section 140, and is generally the portion of tube 120 distant from burner 20. A sparger is commonly known as a sprinkler or a container with a perforated lid. Tube 120 is referred to as having a sparger section 140 because that section includes multiple holes 142 in the bottom of the tube and the exhaust stream from the combustion section, along with any recondensed liquid or nonvolatilized liquid, leaves the tube through the holes. If sparger section 140 is manufactured of 4-inch schedule 10 pipe, for example, holes 142 are approximately ½-inch in diameter and are spaced 1-inch apart on center.

The sections and regions of tube 120 referred to above are provided for reference, and are not subject to precise delineation.

An alternative embodiment of evaporator 10 is shown in FIG. 3. That embodiment incorporates what may be thought of as a catalytic convertor, shown generally at 160. Catalytic convertor 160 includes a region 162 located in tube 120 so that flame 21 and waste liquid from liquid injector 90 are directed toward catalytic converter 160. A catalytic agent 164 is housed within region 162. The preferred catalytic agent is a fibrous wadding of titanium shavings because titanium is resistant to high temperatures. Region 162 also includes a purge hole 166 which allows liquid to be expelled from the region.

Catalytic converter 160 aids in the volatilizing of injected liquid 106 and the burning of any pollutants in the liquid. As shown in FIG. 3, flame 21 is directed into catalytic converter 160, thus heating catalytic agent 164. Since liquid injector 90 is located between burner 20 and catalytic converter 160, any portion of injected liquid 106 that is not volatilized while suspended in flame 21 comes into contact with the hot catalytic agent 164 and vaporizes. Titanium shavings form a fibrous wadding which provides extensive surface area for vaporizing injected liquid 106 when titanium shavings are used as the catalytic agent. The effectiveness of catalytic agent 164 is not dramatically reduced even though deposits may form on it surfaces because the heat from flame 21 will be on the surface of any deposits, so the deposits will not insulate against the heat. Furthermore, catalytic agent 164 protects region 162 from becoming caked with deposits, and agent 164 is easily removed and replaced. Thus, this embodiment of evaporator 10 is much easier to clean than conventional waste liquid evaporators.

Figure 5:
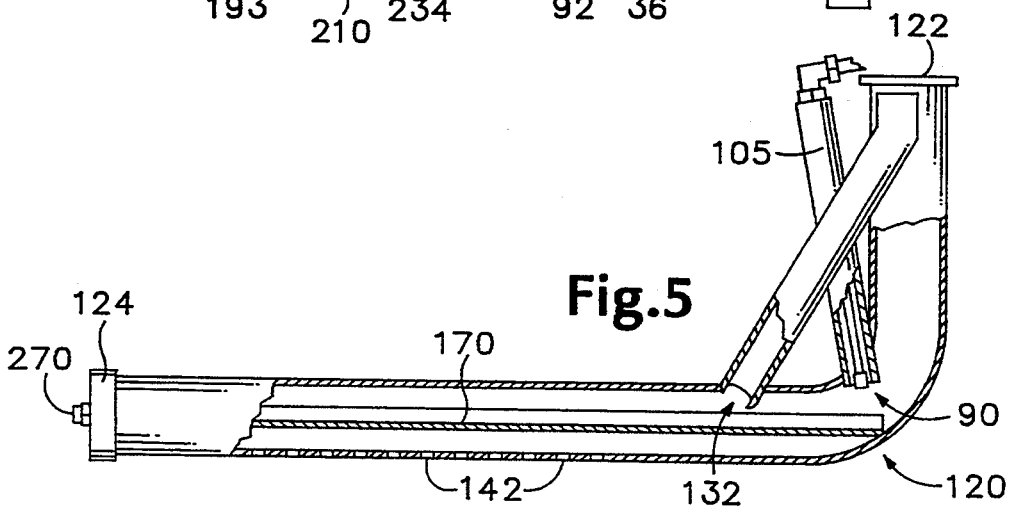
FIG. 5 is a side view of an alternative tube that may be used in the invention, shown removed from the tank and in partial cross-section.

Another alternative embodiment is shown in FIG. 5. That embodiment includes a burner channel 170 inserted into tube 120. Burner channel 170 may be mounted in tube 120 in any manner and may be made from many materials, 304 stainless steel for example. Burner channel 170 provides a removable and replaceable protective barrier to protect tube 120 from the intense heat of flame 21. Burner channel 170 also prevents the build up of deposits on tube 120.

Tube 120, liquid injector 90 and burner 20 are all supported by and positioned within a tank 180, as shown in FIGS. 2 and 3. Tank 180 is preferably a rectangular hopper for holding liquid. Tank 180 catches the vaporized waste liquid, any remaining waste liquid and any particles after the waste liquid is injected into flame 21. Tank 180 includes a vent 182 that allows vapor to leave the tank, either into the air or into another apparatus to recondense or use the vapor. Tank 180 also includes a metal splash plate 184 oversized relative to and positioned under vent 182 to prevent liquid from splashing up and out of vent 182.

In normal operation tank 180 will be filled with a liquid 190 (fresh water for example), as shown in FIG. 3, before any waste liquid is volatilized. Thus, evaporator 10 includes a liquid input 192, shown in FIG. 2, to which a liquid source may be connected by a standard garden hose, for example. A conduit 193 leads from input 192 to a manual control valve 194 (V), and from control valve 194 into a tank inlet 195 near the bottom of tank 180. Inlet 195 includes a sampling port 196 with a manual valve (V) attached thereto. Conduit 193, manual control valve 194 and tank inlet 195 are used to fill tank 180 with sufficient liquid to allow the system to be started. Once the system has been started, additional liquid is added through liquid injector 90.

Tube 120 is positioned in tank 180 so that sparger section 140 and a large part if not all of combustion section 126 are submerged during normal operation. Submerging tube 120 in liquid 190 cools tube 120 from the heat of flame 21 and prevent the tube from deforming or deteriorating.

Vaporized waste liquid, recondensed waste liquid and particles will leave tube 120 through holes 142 and will mix with the liquid in the tank. Thus, liquid 190 will become contaminated and should also be evaporated. This is accomplished by heating liquid 190. That liquid is heated partially from flame 21 heating tube 120, which in turn heats the liquid.

Additionally, the heated gas component of exhaust stream 110 leaves tube 120 in the form of bubbles 198, as shown in FIG. 3, because the sparger section of tube 120 is submerged. The heated gas bubbles then float to the top of the liquid in the tank and either recondense in to liquid or leave the tank through vent 182. The bubbles contact the liquid in the tank and transfer heat to the liquid.

Bubbling exhaust stream 110 through liquid 190 apparently vaporizes the liquid without heating it to its normal boiling point. Presumably the interface between bubbles 198 and liquid 190 is heated to the boiling point of liquid 190, thus vaporizing liquid 190 within bubbles 198, while the average temperature of the liquid stays below the boiling point.

Liquid 190 also cools exhaust stream 110. The vapor leaving tank 180 through vent 182 is therefore much cooler (around 200 to 300 degrees Fahrenheit), which improves the safety of the evaporator.

Liquid 190 also acts as a scrubber, removing particles from bubbles 198. As the bubbles pass through the liquid, particles will settle toward the bottom of the tank.

Increasing the surface contact between bubbles 198 and liquid 190 increases both the removal of particles and the transfer of thermal energy from the bubbles to the liquid. Increased surface contact is accomplished by positioning a series of perforated plates inside of the tank. These are shown as lower perforate plate 200 and upper perforate plate 202, both disposed above holes 142 and submerged within liquid 190 so as to intercept bubbles 198 as they float toward the surface of the liquid. The perforated plates increase the amount of surface contact between the bubbles and the liquid by breaking up large bubbles into many smaller ones, and increase the duration of contact by slowing the ascent of the bubbles.

Tank 180 may also be covered with an insulator 204, such as ceramic paint, to insulate the liquid in the tank. That insulation further increases the evaporator's efficiency.

Additionally, tank 180 includes a drain 206, shown equipped with drain valve 208, in the bottom of the tank. The drain allows the tank to be cleaned and any accumulated particles to be removed.

Tank 180 and the other components are supported on a frame 210 shown in FIG. 2. A protective housing 212, shown in FIGS. 6 through 11, encloses waste liquid evaporator 10, thus protecting the evaporator from wear and tear, and preventing accidental user contact with the moving parts and hot surfaces of the evaporator. Housing 212 includes side panels shown generally at 214, which incorporate louvers 216, ornamentally positioned on the panels to provide ventilation. A control panel 218 contains burner controls 220. Alternatively, control panel 218 and burner controls 220 can be enclosed in a water-tight control box.

To start operation of the evaporator, tank 180 is first filled with liquid, usually fresh water. While it is possible to fill the tank with waste liquid, this would bypass the purification that occurs when the waste liquid is injected into flame 21.

When tank 180 fills with liquid, tube 120 also fills with liquid. Thus, the liquid must be purged from tube 120 before burner 20 produces a flame. Air injector 64 and second air injector 132, or only one of them, inject air into tube 120 for a predetermined period of time to purge liquid from the tube. A liquid purge interlock 230, which is preferably a delay timer that disables burner 20 for a predetermined period of time, controls the purging of liquid from tube 120. A pressure sensor 232 (PS) provides verification that air supply line 56 is pressurized. An example of pressure sensor 232 is manufactured by Antunes Controls of Addison, Ill., Model JD-2. Pressure sensor 232 is monitored for the duration of the delay, thus ensuring that air is being forced into tube 120. It has been found that a delay of 15 seconds sufficiently purges tube 120 of liquid.

Fuel is then provided to burner 20 and spark plug 70 ignites the fuel to produce flame 21. Liquid injector 90 then injects a fine spray of waste liquid into the flame and the liquid is volatilized and pollutants are burned. The resulting exhaust stream then leaves tube 120 through the sparger section and bubbles through the liquid in tank 180. The bubbles and tube 120 both transfer heat to the liquid in the tank and thereby create more vapor. Vapor then leaves the tank through vent 182.

The pressure at liquid pump 96 drops as liquid is sprayed into flame 21 by injector 90. Thus a high/low-pressure pump control switch 234 (PS) is provided to turn pump 96 on when the pressure drops below a preset point, and to turn pump 96 off when the pressure exceeds a preset limit. A liquid shut-off solenoid valve 236 (SV) allows automatic on-off control of the liquid supply assembly, thus controlling liquid injector 90. A liquid flow control valve 238 (V) provides a regulator by which the flow rate of the liquid in supply line 98 can be regulated. A flow meter 240 (FM) provides visual indication of the flow rate of the liquid in supply line 98. An example of flow meter 240 is manufactured by Blue White Industries of Westminster, Calif., Model 9304.

Continuous operation of waste liquid evaporator is achieved by monitoring the level of the liquid in the tank and controlling liquid injector 90 accordingly. A sensor 250 is disposed within tank 180 to provide control of the liquid level in the tank. Sensor 250 includes a high-liquid switch 252 (LS) that senses when the liquid in the tank has risen to a level that exceeds a preset limit, and then shuts off liquid injector 90 by closing liquid shut-off solenoid valve 236. Sensor 250 also includes a low-liquid switch 254 (LS) that reactivates liquid injector 90 if the injector has been deactivated by high-liquid switch 252 and the level of liquid 190 in tank 180 has dropped below a preset limit. Thus sensor 250 triggers at least one predetermined function by either stopping waste liquid injector 90 from injecting waste liquid when the liquid level in tank 180 is at a predetermined level or reactivating liquid injector 90.

Safe operation of waste liquid evaporator 10 is maintained by system shut-off controls. A system shut-off switch is shown at 260 (LS), and deactivates the burner 20 and liquid injector 90 when the level of liquid 190 in tank 180 has dropped below a preset limit. System shut-off switch 260 senses a liquid level which is below that of both high-liquid switch 252 and low-liquid switch 254. A high-temperature switch 262 (TS) deactivates both burner 20 and liquid injector 90 if the temperature of liquid 190 in tank 180 exceeds a preset limit. The preset limit of high-temperature switch 262 is selected to slightly exceed the boiling point of liquid 190. For example, the preferred temperature limit for evaporating waste water is 220 degrees Fahrenheit. All of the electrical components described above, including solenoid switches, blowers and pumps, may be electrically wired in any known manner.

Waste liquid evaporator 10 is also provided with several visual indicators of system operation. A combustion view port, shown at 270 in FIGS. 2 and 3, allows observation of the combustion and vaporization occurring within tube 120. An example of combustion view port 270 is manufactured by Eclipse Combustion and is a single piece peepsight, Eclipse assembly no. 11737. A view-plate 272 in the top of tank 180 allows viewing of the interior of tank 180. A visual level indicator 274, preferably a sight tube, is attached to tank 180 to show the level of liquid 190 in tank 180. A flow indicator 276 (FI) provides visual confirmation that waste liquid is flowing to liquid injector 90.

Figure 6:
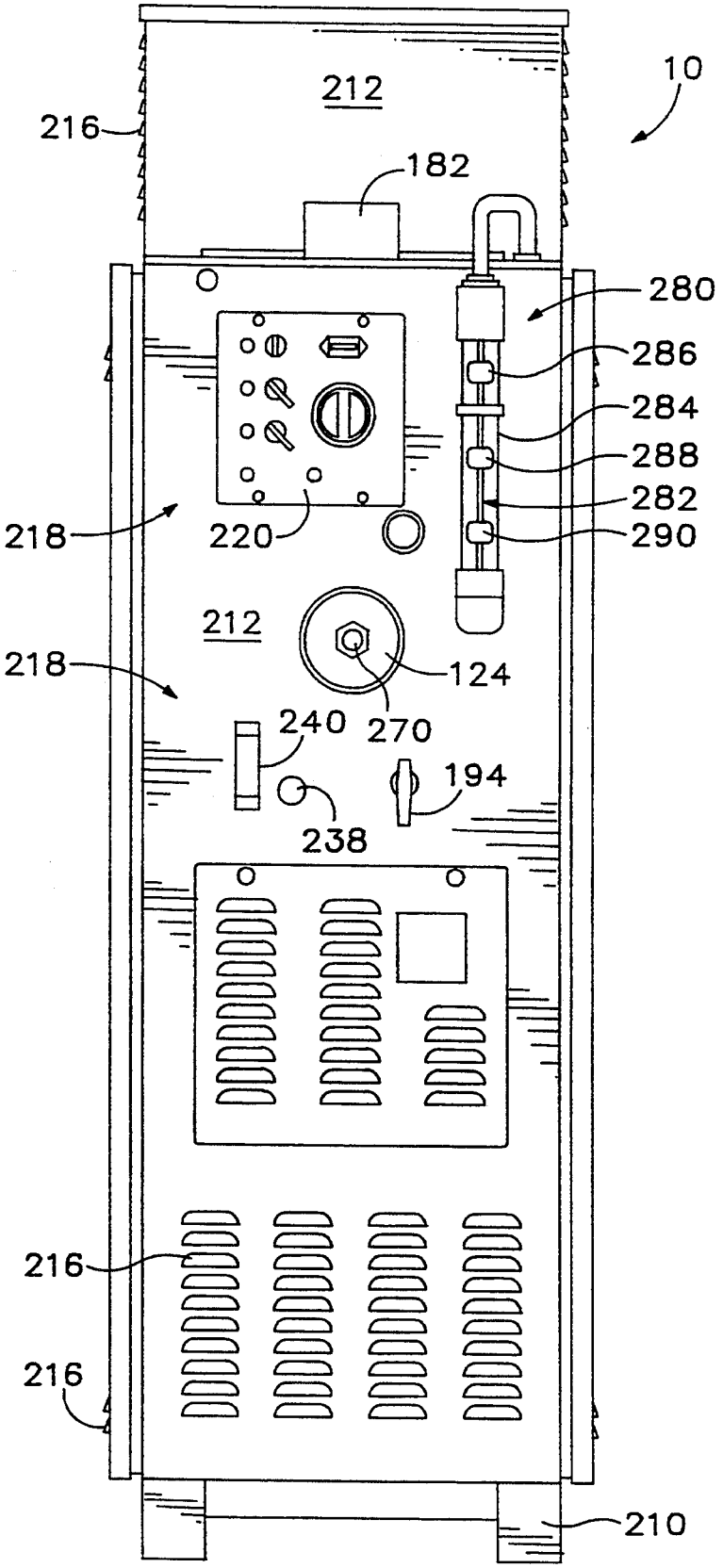
FIG. 6 is a front view of the waste liquid evaporator shown in FIG. 1, showing an alternative embodiment of several parts.
Figure 7:
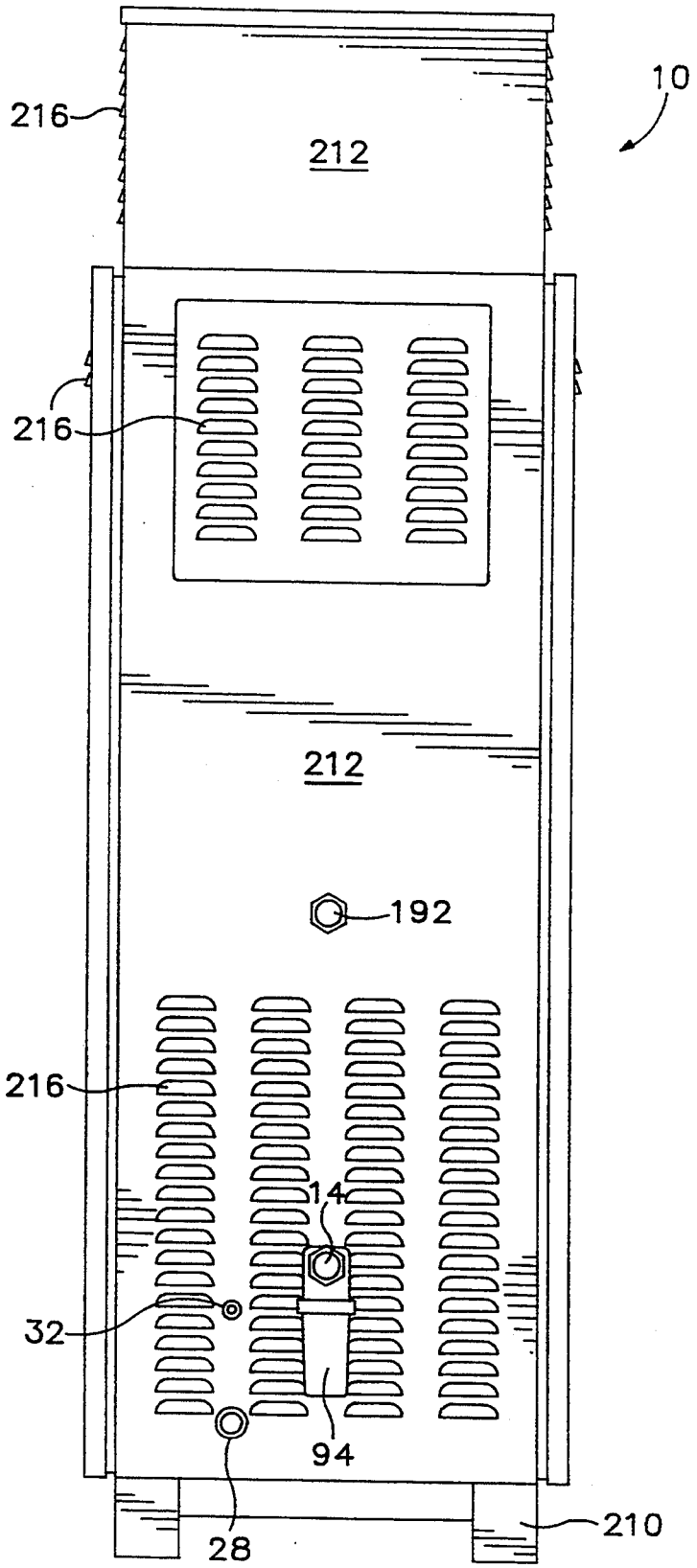
FIG. 7 is a rear view of the waste liquid evaporator shown in FIG. 1.
Figure 8:
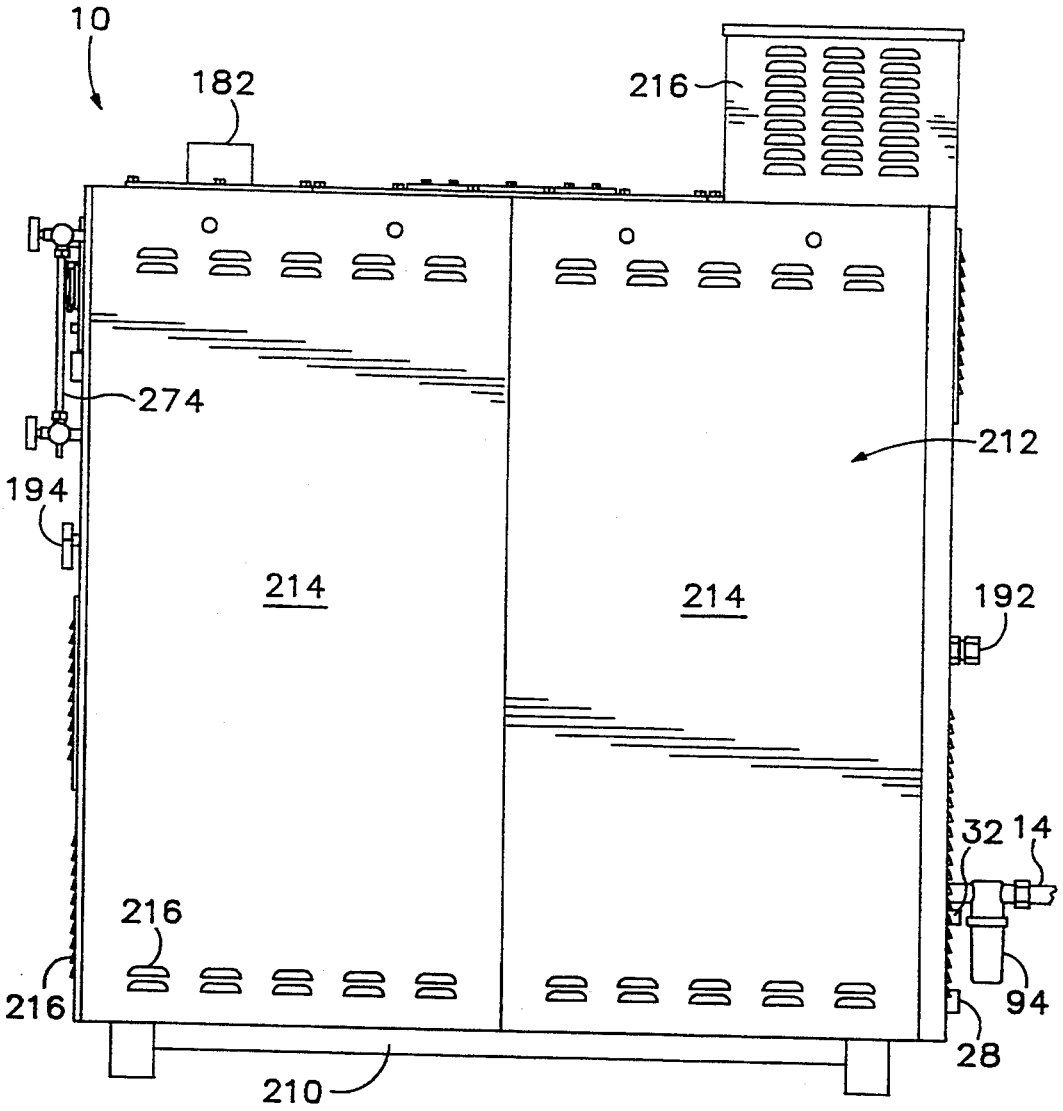
FIG. 8 is a right side view of the waste liquid evaporator shown in FIG. 1.
Figure 9:
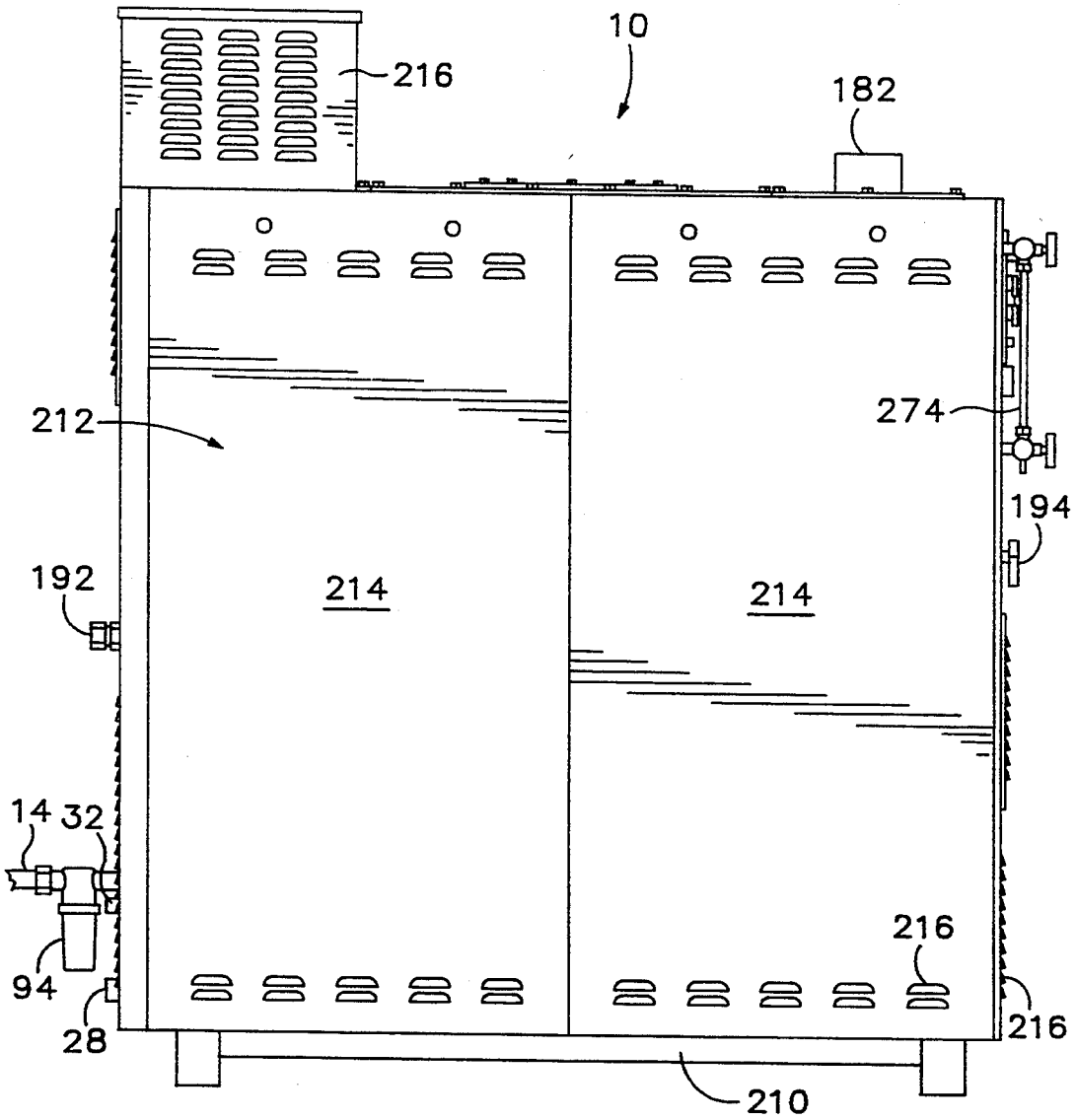
FIG. 9 is a left side view of the waste liquid evaporator shown in FIG. 1.
Figure 10:
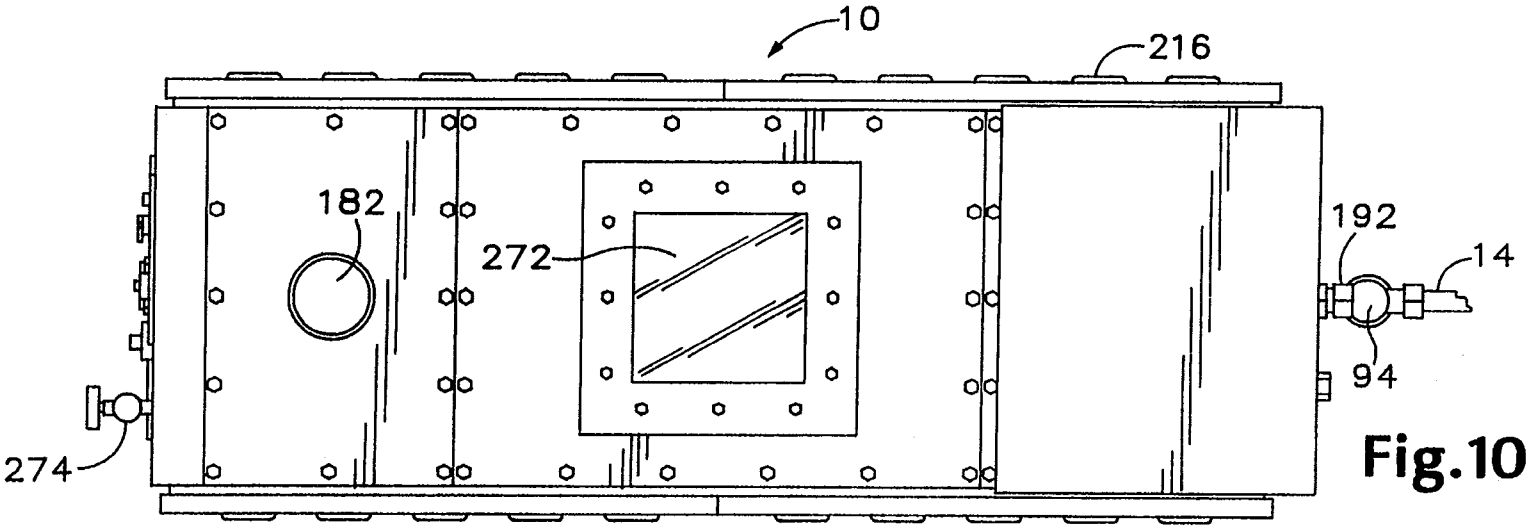
FIG. 10 is a top view of the waste liquid evaporator shown in FIG. 1.
Figure 11:
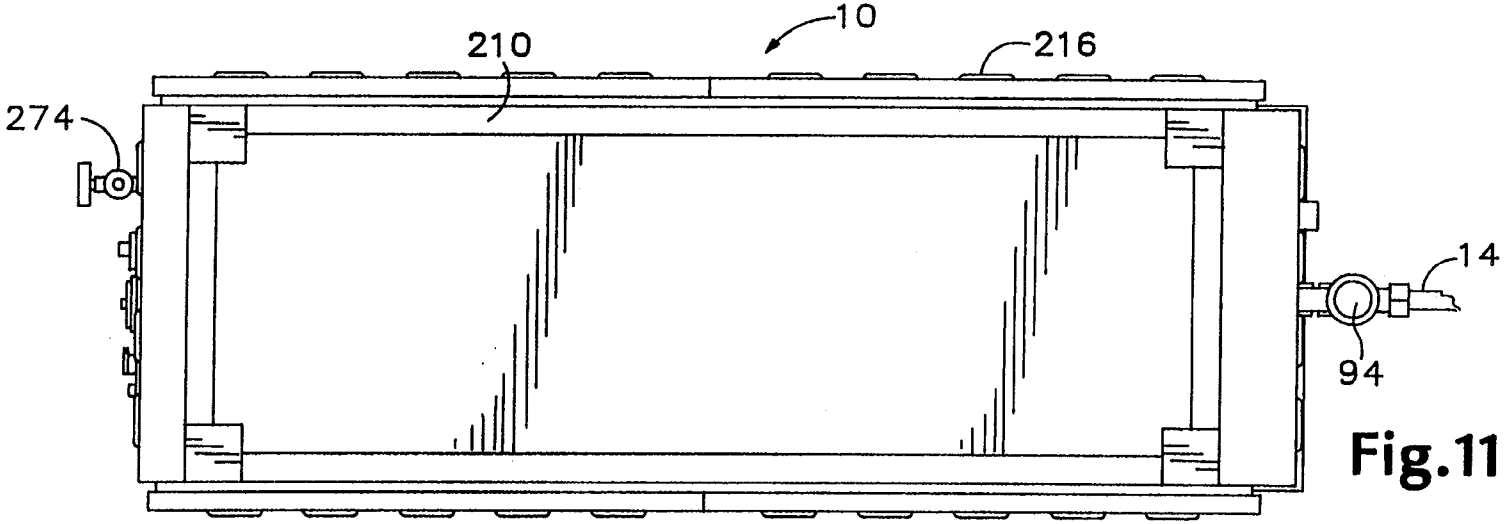
FIG. 11 is a bottom view of the waste liquid evaporator shown in FIG. 1.

An alternative embodiment of evaporator 10 is shown in FIG. 6, in which high-liquid switch 252, low-liquid switch 254, system shut-off switch 260 and visual level indicator 274 are integrated into a single assembly, shown at 280. Assembly 280 is made by inserting a level sensor 282 inside of a clear tube 284. Level sensor 282 can incorporate a high-liquid switch 286, a low-liquid switch 288 and a system shut-off switch 290. Assembly 280 communicates with tank 180 such that the level of liquid 190 is visible within clear tube 284, and acts on level sensor 282.

INDUSTRIAL APPLICABILITY

The invented evaporator and method are applicable in any situation where water needs to be cleaned and/or evaporated. It is particularly applicable for industrial waste water disposal and cleansing.

While a preferred embodiment of the invented waste liquid evaporator and method have been disclosed, changes and modifications can be made without departing from the spirit of the invention.

We claim:

1. A waste liquid evaporator comprising:

a tank constructed to hold a liquid;

a tube within the tank having a combustion section and a sparger section;

a burner positioned to produce a flame within the combustion section;

a waste liquid injector positioned to inject waste liquid into the flame within the combustion section to burn at least a part of any combustible pollutants in the waste liquid and to produce vapor from at least a part of the waste liquid;

at least one hole in the sparger section to allow waste liquid from the injector and vapor to leave the tube; and a vent in the tank to allow vapor to leave the tank.

2. The evaporator of claim 1 wherein at least a part of the combustion section and at least a part of the sparger section are positioned to be submerged in liquid in the tank.

3. The evaporator of claim 2 further comprising at least one perforated plate positioned to be at least partially submerged in liquid in the tank above the sparger section to disperse at least a part of any vapor leaving the sparger section.

4. The evaporator of claim 2 wherein the burner includes an air injector.

5. The evaporator of claim 4 further comprising a liquid purge interlock that disables the burner for a predetermined period of time allowing the air injector to purge liquid from the tube.

6. The evaporator of claim 4 wherein:

the combustion section has a first end region and a second end region;

the burner is positioned to produce the flame in the first end region so that the flame extends toward the second end region; and a second air injector is connected to the tube and positioned to inject air into the second end region.

7. The evaporator of claim 1 further comprising a view port positioned to allow visual observation of the flame.

8. The evaporator of claim 1 further comprising a region within the combustion section housing a catalytic agent.

9. The evaporator of claim 8 wherein the catalytic agent is a fibrous wadding of titanium.

10. The evaporator of claim 1 wherein the burner includes a flame tube to focus the flame.

11. The evaporator of claim 1 wherein the flame tube includes a tapered end.

12. The evaporator of claim 1 further comprising an insulator covering the tank.

13. The evaporator of claim 1 wherein the waste liquid injector includes a nozzle to disperse the liquid.

14. The evaporator of claim 1 further comprising a sensor within the tank to detect liquid level in the tank and to trigger at least one predetermined function depending on the liquid level in the tank.

15. The evaporator of claim 14 wherein one predetermined function triggered by the sensor is to stop the waste liquid injector from injecting waste liquid when the liquid level in the tank is at a predetermined level.

16. The evaporator of claim 1 wherein the tank includes a drain and a drain valve.

17. A method of evaporating waste liquid comprising:

producing a flame;

injecting waste liquid into the flame to burn at least a part of any combustible pollutants in the waste liquid and to produce vapor from at least a part of the waste liquid;

providing a tank;

initially filling the tank with liquid to a predetermined level;

providing a tube having a submergible combustion section and a submersible sparger section;

submerging at least a part of the sparger section in the liquid in the tank;

directing the flame and injected waste liquid into the combustion section;

providing at least one hole in the sparget section through which the waste liquid and the vapor leave the tube after the waste liquid is injected into the flame;

catching in the tank the waste liquid and the vapor after the waste liquid is injected into the flame; and providing a vent in the tank to allow the vapor to leave the tank.

18. The method of claim 17 further comprising:

submerging at least one of the holes in the sparger section thus passing waste liquid and vapor through the liquid in the tank;

heating the liquid in the tank by heating the tube with the flame, whereby the heated tube heats the liquid along the submerged portions of the tube; and heating the liquid in the tank by heating the waste liquid and vapor in :he tube with the flame, whereby the heated waste liquid and heated vapor heat the liquid in the tank by passing through the liquid in the tank.

* * * * *